US005857008A

United States Patent [19]

Reinhold

[11] Patent Number: 5,857,008

[45] Date of Patent: Jan. 5, 1999

[54] MICROFOCUS X-RAY DEVICE

[76] Inventor: Alfred Reinhold, Sperbersloher Strasse 568, D-90530 Wendelstein, Germany

[21] Appl. No.: 913,714

[22] PCT Filed: Mar. 16, 1996

[86] PCT No.: PCT/EP96/01145

§ 371 Date: Jan. 8, 1998

§ 102(e) Date: Jan. 8, 1998

[87] PCT Pub. No.: WO96/29723

PCT Pub. Date: Sep. 26, 1996

[30] Foreign Application Priority Data

Mar. 20, 1995 [DE] Germany ..... 195 09 516.2

[51] Int. Cl.[6] ..... H01J 35/30

[52] U.S. Cl. ..... 378/137; 378/126

[58] Field of Search ..... 378/125, 126, 378/137

[56] References Cited

U.S. PATENT DOCUMENTS 4,344,013 8/1982 Ledley .
4,896,341 1/1990 Forsyth et al. ..... 378/126

FOREIGN PATENT DOCUMENTS 0150364 8/1985 European Pat. Off. .
0319912 6/1989 European Pat. Off. .
0461776 12/1991 European Pat. Off. .
2333344 6/1977 France .
3307019 8/1984 Germany .

OTHER PUBLICATIONS

"Electron Beam Melting in Microfocus X–Ray Tubes", by Grider et al, J. Phys. D. ppl. Phys 19 (1986) pp. 2281–2292.

*Primary Examiner*—Craig E. Church
*Attorney, Agent, or Firm*—Sughrue, Mion, Zinn, Macpeak & Seas, PLLC

[57] ABSTRACT

In microfocus X-ray equipment for enlarging radiographic short-time recordings, a focussed electron beam for the production of X-radiation (16) impinges on the retarding material of a target (23). In this case, the retarding material in the focal spot (22) passes over into the liquid aggregate state due to the high thermal loading. For this reason, the equipment is operated in pulsed operation, wherein the position of the focal spot (22) on the target (23) is, when each loading occurs, displaced relative to the previous position. The retarding material is arranged in a retarding layer (32) on a carrier layer (33) and the electron beam (16) impinges on the retarding layer (32) oriented perpendicularly to the electron beam (16). A control interrupts the irradiation at the latest when the carrier layer (33) starts to melt.

2 Claims, 3 Drawing Sheets

MICROFOCUS X-RAY DEVICE

DESCRIPTION

Figure 1:
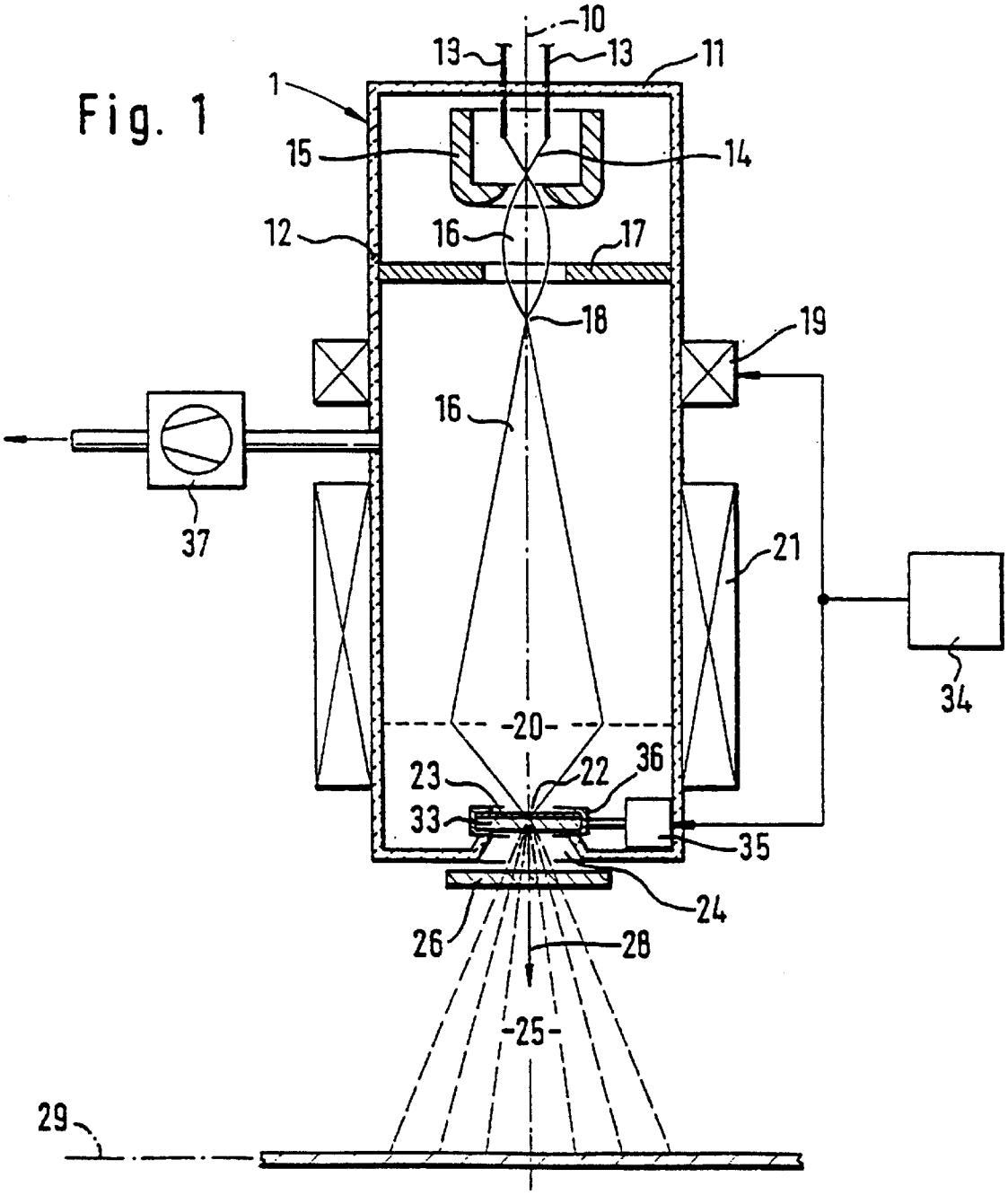

The invention relates to equipment of the kind known from U.S. Pat. No. 4,344,013 (Ledley).

The usability of so-called direct and enlarging radiographic equipment, in particular in the fields of material testing and medicine, is described more closely in the contribution "Entwicklung und Perspektiven der medizinischen Vergrösserungsradiographie" by G. Reuther, H. -L. Kronholz and K. B. Hüttenbrink in RADIOLOGE, volume 31 (1991), pages 403 to 406. The function of such equipment is based on the radiation-geometric law, according to which a radiation source leads to high-contrast shadow images of high local resolution only when the radiation surface effective for imaging is very small by comparison with the irradiated surface of the object to be imaged, because otherwise each point of the object would be irradiated at different angles, thus from different places of the radiation source, each object point on projection into the image plane would result in shadow casts displaced relative to one another and the result altogether would be a smudged outline of the object which is illustrated enlarged according to its distance from the image plane.

In spite of the improvement in the resolution achievable thereby, items of microfocus X-ray equipment have not been able to gain acceptance so well in practice, in particular in medical diagnosis. This appears to be traced back above all to them being able to operate only with restricted X-ray power, because the very narrow focussing of the electron beam onto the retarding target results in a focus spot (focus) of very small diameter with correspondingly high energy density. This high specific loading rapidly leads to the target, which is usually irradiated at a direction of 10° to 45°, experiencing a change, which is disadvantageous for the conversion of the impinging electron beam energy into X-ray energy to be delivered, in its topography with rapid destruction of the retarding layer. Otherwise, the exposure time per X-ray recording would have to be prolonged when X-rays of lower power were to be used, which would, however, contradict the demand for short exposure times in the range of tenths to hundredths of seconds in order to avoid an unnecessarily high beam loading and defocussing due to the movement of the object. However, the smaller the thermal focus spot is on the target anode, the lower also becomes the electrical power which can be received by the small target area before it begins to melt. This behaviour thus contradicts the requirement for higher density of the electron beams impinging on the target for higher power of the X-ray radiation.

An item of microfocus X-ray equipment, which operates already with a target that has begun to melt, is known from the initially mentioned U.S. Pat. No. 4,344,013 (Ledley). In this equipment, the electron beam impinges on an obliquely set target, so that the produced X-radiation is similarly radiated away from the target at an angle. However, in this equipment, it has not been taken into consideration that a rapidly progressing crater formation leads, even before complete burning-through of the target, to the optical axis of the useful radiated X-ray radiation experiencing a shadowing by the crater rim that is swelling up and absorbs the X-ray radiation to a large extent. There results a diffuse X-ray light which cannot be regarded as emanating from a punctiform source. For that reason, equipment of that kind with an oblique setting of the target relative to the incident electron beam has not proved itself.

German preliminary published specification (DE-OS) 34 01 749 A1 (Siemens) concerns X-ray equipment in which the electron beam is deflected constantly and, for example, in meander shape on the retarding material. However, the effective focus spot is thereby enlarged, as a result of which the image sharpness suffers, as described above.

A transmission target, in which the retarding material is arranged on a carrier material, is known from German preliminary published specification (DE-OS) 26 53 547 A1 (Koch and Sterzel). The avoidance of a critical thermal loading, as occurs in microfocus equipment, is not discussed in this specification.

The invention therefore has the object of opening up further fields of use for microfocus radiography in that a radiation-geometrically available X-ray radiation is produced in spite of minimised focal spot diameter on the target.

Developments and refinements of the invention are claimed in the subclaims.

Figure 2:
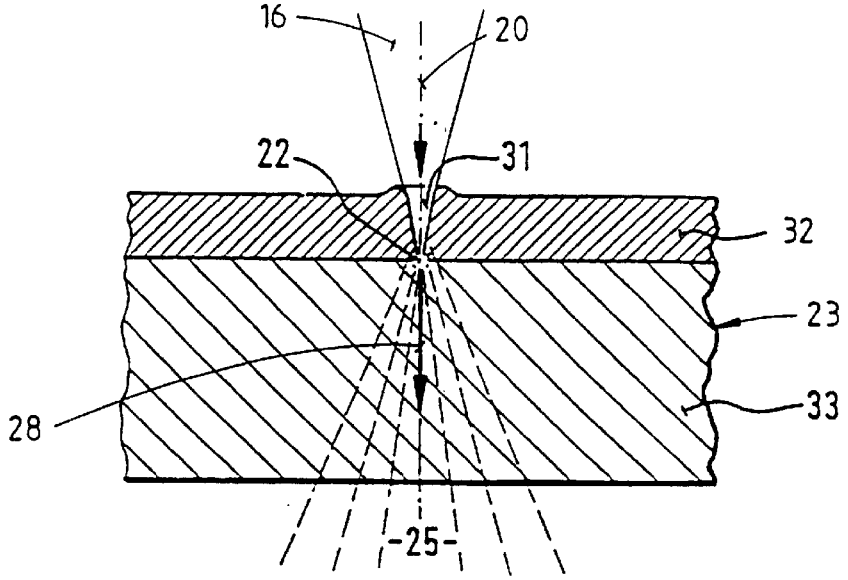
Figure 3:
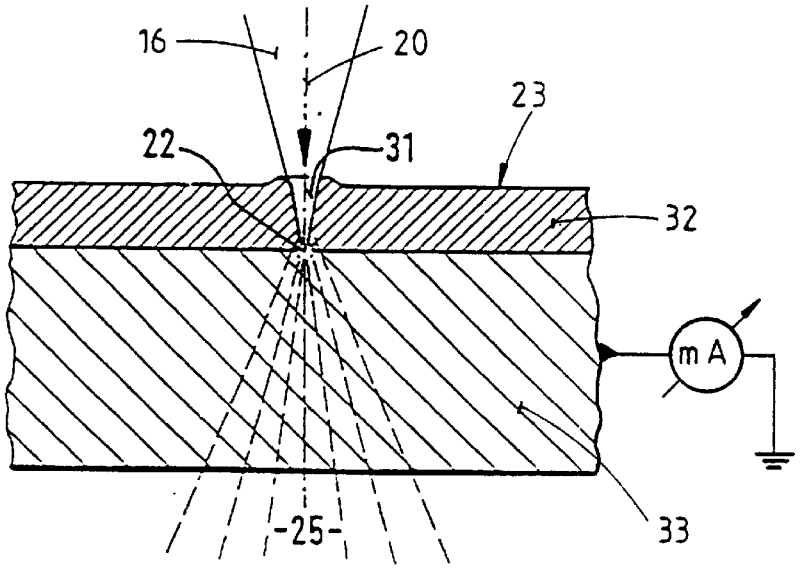
Figure 3A:
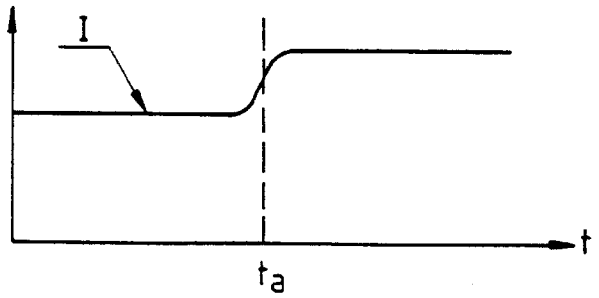
Figure 4:
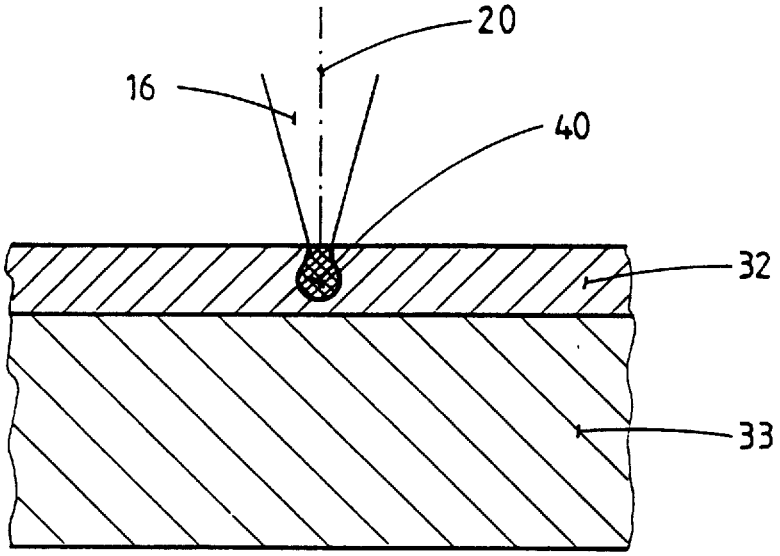
Figure 4A:
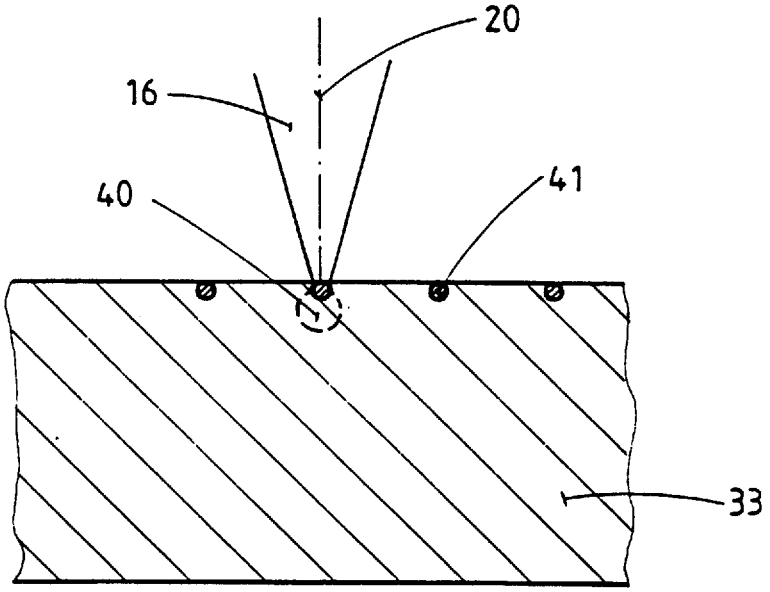

An embodiment of the invention is illustrated in the drawings, in which:

FIG. 1 is a schematic longitudinal section through microfocus X-ray equipment, FIG. 2 is a section through the target to enlarged scale, FIG. 3 is the target according to FIG. 2 with a measurement of the target current, FIG. 3A is the course of the target current in dependence on the duration of exposure, FIG. 4 is a target with a retarding volume drawn in and FIG. 4A is a carrier layer with carrier material dopings.

The microfocus X-ray equipment 1 consists of an evacuated housing 11 and 12 of glass or non-ferromagnetic metal. The tube 12 has any desired cross-section, which as a rule is round. Electrical feed wires 13 for a cathode 14 in the form of a hair needle project through a rearward end face 11 of the tube 12 into the interior of the tube 12. The heated cathode 14 acts as an electron source, from the radiation of which a small divergent electron beam 16 is masked out by means of a cap-shaped grid 15. The beam 16 passes through the central opening of a perforated disc anode 17 and in that case experiences a focussing to a virtual focal spot 18. The beam 16, which thereafter widens out again, passes through the cross-sectional zone of a deflecting coil 19 arranged externally of the tube 12 and is focussed in the magnetic gap 20 of an adjoining focussing coil 21. The focussing coil 21 as electromagnetic lens forms a reduced image of the virtual focal spot 18 as a focal spot 22 on a transmission target 23, which is disposed in the exit opening 24 of the tube 12. The focussing coil 21 produces a focal spot 22 of extremely small area in the order of magnitude of typically 0.5 to 100 micrometres. The target 23 consists of a thin retarding layer 32 of a metal of high atomic number in the periodic system of elements, such as tungsten, gold, copper or molybdenum, and a carrier layer 33, preferably of aluminium or beryllium, which absorbs X-rays poorly, but is thermally highly conductive. In consequence of the retarding effect of the target material, the impinging electrons of the beam 16 initiate the X-radiation 25. A part of the X-ray radiation 25 penetrates the target 23 with the beam direction 28, which coincides with the beam axis 10 of the electron beam 16, and leaves the tube 12 in the direction towards a sample 26 as a divergent X-ray beam 25. By reason of the geometric radiation law, the structure of the sample 26, insofar as it is more or less impermeable by the X-rays 25, is projected correspondingly enlarged in the image plane 29 as shadow outline onto a film arranged at a greater spacing behind the sample 26 parallel to the transmission target 23 and thus perpendicularly to the beam direction 28.

A suction plant 37 for maintenance of the vacuum in the tube 12 and for extraction of vaporous material traces of the cathode 14 to be combusted acts at the same time to keep the interior space of the tube 12 clean of molten material particles from the focal spot hole 31 in the target 23.

The particularly high yield of X-rays 25 results from the excited retarding volume 40 of extremely small area (FIG. 4) in the transmission target 23. The high power density, thus the high physical loading per unit area by the microfocussed electron beam 16, leads to the burning of a focal spot hole 31 into the target 23, so that the remaining target material and thereby its radiation-attenuating inherent absorption reduces continuously in the departure direction 28 of the X-rays 25. The retarding layer 32 is melted away in targeted manner by the impinging electron beam 16, which with respect to its aggregate state represents a dynamically changing X-ray source.

When the retarding material is borne as a thin layer, possibly of tungsten, on a carrier layer 33, which is thick by comparison therewith and of thermally highly conductive material, such as beryllium or aluminium, then it is hardly avoidable, but also uncritical, that at the base of the hole 31 in the retarding layer 32 the carrier layer 33 lying therebehind in radiation direction 28 is also ultimately melted by the microfocussed electron beam 16. Then, however, the radiation of the target 23 must be terminated at this position, thus the recording be ended in the application of this X-ray equipment 1, because the loading of the carrier layer 33 by electron beams 16 leads only to a very soft X-radiation 25 and thus to hardly usable diffuse shadow images of the sample 26, which is to be transilluminated, in the image plane 29.

For the next X-ray shadow image to be recorded, the very brief irradiation of the transmission target 23 is again affected by a microfocussed electron beam 16, for which purpose the cathode 14 is again operated for only a short time and/or the beam 16 is freed only briefly by way of a pivotable aperture stop, which is not illustrated in the drawing, or the beam 16 is pivoted by way of a corresponding drive control of the deflecting coil 19 briefly from a non-functional waiting direction into the instrument—and effective—axis 10 of the beam direction 28. However, at the transmission target 23, a place at which a hole 31 has been presumably burnt in may not be irradiated again, because otherwise the carrier layer 33 would soon or even immediately be melted instead of the retarding layer 32 of retarding material. For that reason, the displacement control 34 is provided, which, by the afore-described beam deflection by means of the deflecting coil 19 from the instrument axis 10 and/or through redisposition of the target 23 relative to the instrument axis 10, ensures that successive focal spots 22 are caused only along a path extending in meander or spiral shape. It is thereby ensured that only unused regions of the target 23 are loaded one after the other and thus a destruction of the carrier layer 33 with initiation of only little useful, and moreover low-energy, X-radiation is avoided. The target 23 is thus so loaded in transmitted light operation by the perpendicular charging by electrons until an aggregrate conversion into the molten phase sets in.

For illustration of the redisposition of the target 23 relative to the tube 12 or its axis 10, a positioning motor 35 is disposed in the tube, illustrated graphically in the drawing. Instead thereof, the target 23 together with the positioning motor 35 can basically also be retained in vacuum-tight manner at the end face in front of the exit 24 of the tube 12 or a linkage from an external arrangement of the positioning motor 35 engages through the wall at a rotary or sliding mount 36 for the target in the interior of the tube 12.

As has been explained in the preceding, the redisposition of the target 23 must take place whenever the electron beam 16 has burnt the microhole 31 so deeply into the retarding layer 32 that it reaches the carrier layer 33.

A simple procedure for ascertaining this instant consists in that after a short exposure time, which can be estimated with reference to the power or even more easily can be determinable empirically, in the order of magnitude of milliseconds or microseconds, the focal spot production on the target 23 is to be terminated, for which purpose the electron beam can be switched off, masked off or pivoted out of the target range, as already described in the preceding. This procedure does not, however, take the individual state of the microhole 31 into consideration. It can thus well be the case that the carrier layer 33 in this procedure is already irradiated or that the microhole 31 on the other hand has not yet reached the boundary between the retarding layer 32 and the carrier layer 33.

A substantially more accurate method for ascertaining the instant $t_a$ at which the retarding layer 32 is molten through and the electrons impinge on the carrier layer 33, is measurement, which is reproduced in FIG. 3, of the target current I. When the target current I is measured, as illustrated in FIG. 3, as a function of the exposure time t, then this has the course illustrated in FIG. 3A. At the instant $t_a$, a sudden increase in the target current takes place. The instant $t_a$ is that instant at which the electron beam has penetrated the retarding layer 32 and the microhole 31 reaches to the carrier layer 33. By measurement of the target current I, a command for deflection of the electron beam 16 can thus be obtained very easily by the control. In this case, all local characteristics of the retarding layer 32 and the carrier layer 33 are automatically taken into consideration.

When an electron accelerated in a high-voltage field penetrates into the surface of matter, it experiences a sequence of elastic impacts, during each of which it loses a part of its kinetic energy which converts into radiation, in reaction with the matter. A part of this radiation consists of X-radiation. During the sequence of elastic impacts, the electron passes within the target material through a retarding volume 40 (FIG. 4), the extent of which is determined primarily by the atomic number Z of the target material, the energy $E_o$ of the electrons and by the electron beam diameter t.

The X-radiation rises within the described retarding volume 40. The extent of the radiation source is thus determined by the magnitude of the retarding volume 40. Even if an electron beam diameter d tending to "zero" is assumed, a finite retarding volume 40 remains in consequence of the spreading of the electrons. Thus, a minimum radiation source size determined substantially by $E_o$ and Z can in principle not be fallen below.

If now a further reduction in size of the radiation source is to be achieved, target material dopings 41 (FIG. 4A) must be introduced into the carrier material, the volumes of which are each significantly smaller than the afore-described retarding volume 40 of the electrodes in a coherent target material.

The usable X-radiation arises only in target material of higher atomic number. The electrons, which have penetrated from the target material dopings 41 into the carrier material of lower atomic number, do not contribute to the usable X-radiation, as also the electrons penetrating directly into the carrier material beside the dopings 41 do not contribute substantially to the usable radiation.

Since fewer X-ray photons per unit time for the same electron beam density thus arise in the small doping volumes according to FIG. 4A than in the greater retarding volumes 40 in a retarding layer 32 (FIG. 2), the electron beam density (current) must be increased. Although this leads to a rapid melting-away of the target material dopings 41 and their carrier material surrounding, the X radiation arising during the melting process can, however, also be utilised. For the next X-ray recording, the electron beam 16 is deflected in known manner to a still unused doping place 41 and so forth. The dopings 41 can, for example, be arranged in a defined raster.

LIST OF REFERENCE SYMBOLS

1 microfocus X-ray equipment
10 instrument and beam axis
11 end face
12 tube
13 feed wires
14 cathode
15 grid
16 electron beam
17 perforated disc
18 virtual focal spot
19 deflecting coil
20 magnetic gap
21 focussing coil
22 focal spot
23 transmission target
24 exit opening
25 X-radiation
26 sample
28 radiation direction of the X-rays
29 image plane
31 microhole
32 retarding layer
33 carrier layer
34 displacement control
35 positioning motor
36 rotary or slide mounting
37 suction plant
40 retarding volume
41 dopings

I claim:

1. Microfocus X-ray equipment comprising generating means for generating a focused electron beam for impinging perpendicularly on a target for the purpose of production of X-ray radiation, the target having a carrier layer and a retarding layer at a side of the carrier layer facing the beam and the retarding layer comprising a retarding material which changes at the focal spot of the beam into at least the liquid aggregate state under the thermal loading of the beam, displacing means for displacing the focal spot on the target relative to the previous spot position with each said thermal loading, and control means for interrupting the beam at the latest when the carrier layer starts to melt and for determining the instant of said start of melting of the carrier layer by measurement of the target current.

2. Equipment according to claim 1, wherein the retarding material is present in the form of dopings in the carrier layer.

* * * * *